US006938573B1

(12) United States Patent
Garelick

(10) Patent No.: US 6,938,573 B1
(45) Date of Patent: Sep. 6, 2005

(54) DECK ATTACHED MOUNTING APPARATUS FOR BOARDING LADDER

(75) Inventor: Richard J. Garelick, Minneapolis, MN (US)

(73) Assignee: Garelick Mfg. Co., St. Paul Park, MN (US)

( * ) Notice: Subject to any disclaimer, the term of this patent is extended or adjusted under 35 U.S.C. 154(b) by 11 days.

(21) Appl. No.: 10/841,664

(22) Filed: May 10, 2004

(51) Int. Cl.[7] ..... B63B 17/00

(52) U.S. Cl. ..... 114/362; 114/364

(58) Field of Search ..... 182/92, 127; 114/362, 114/364, 363, 343, 218, 268

(56) References Cited

U.S. PATENT DOCUMENTS 4,148,465 A * 4/1979 Bowman ..... 254/334
4,799,447 A * 1/1989 Hebert et al. ..... 144/362
5,197,406 A * 3/1993 Rabal et al. ..... 114/363

OTHER PUBLICATIONS

Garelick Product Catalog © 2001 pp. 6 and 7.

* cited by examiner

*Primary Examiner*—Ed Swinehart

(57) ABSTRACT

A bracket is attachable to the top surface of a rigid support platform, such as a boat deck or dock, and a latch member is removably coupled to the bracket at about one end of the latch member and extends out beyond the edge of the platform and the latch member has a pivot pin at its outer end for pivotably engaging a boarding ladder.

3 Claims, 4 Drawing Sheets

19
30
20
21
23
24
15
11
9
12
26
26
25
14
16
10A
8
10B
10

DECK ATTACHED MOUNTING APPARATUS FOR BOARDING LADDER

FIELD OF THE INVENTION

This invention is aimed at apparatus for releasably attaching a boarding ladder to s supporting platform such as the deck of a boat or to a dock. In particular, the invention is aimed at releasably attaching the ladder to the top surface of the deck or the dock yet allowing the ladder to swing downward over the edge of the deck or dock into the water.

DESCRIPTION OF THE PRIOR ART

Pending application by Garelick, et al., Ser. No. 10/802,310 titled BOARDING LADDER MOUNTING APPARATUS filed on Mar. 18, 2004 describes apparatus for releasably mounting a boarding ladder to the side of a boat or a dock with provisions for mounting the ladder in such a fashion that it can be pivotably swung with respect to the side of the boat or deck. Releasable mounts for boarding ladders known in the prior art at that time are described and disclosed in the aforementioned application. The device described and illustrated in the Garelick, et al. application comprises a bracket attached vertically to the side of a boat or a dock with a slot for releasably engaging an end of a latch member which has a pivot pin at its other end for swingably or pivotably engaging a boarding ladder at about the top end of the ladder. When the latch member is engaged the pivot attachment allows the ladder to be swung with respect to the supporting dock or boat for convenience of the user and to help prevent the ladder from being stripped away from its mount in the event of a somewhat wavy sea or lake. As part of the pivotal attachment is a feature which allows the ladder to be set at an angle with respect to the support structure for the convenience of the user.

SUMMARY OF THE INVENTION

A mounting bracket is attached to the top surface of a rigid supporting platform such as a boat deck or a dock and includes means for releasably coupling a latch member or latch arm at one end. Preferably the bracket is horizontal and lies flat on the horizontal surface that it rests on to present a low profile and does not constitute an impediment or danger to anybody strolling or walking on the supporting platform. Preferably the latch member is angled so that it extends upward and outward when it is engaged with the bracket to extend over the outer edge of the supporting surface, be it a dock or a boat deck, and has at about its far end a pivot pin for pivotally engaging a boarding ladder at about the upper end of the ladder. The attached boarding ladder can then swing similar to the device described in the aforementioned Garelick, et al. application. Adjustable stops may also be provided to permit the boarding ladder to be set at suitable angles for the convenience of the user similar to the aforementioned Garelick, et al. application.

It has been found in many instances it is safer and/or more convenient to be able to couple and uncouple the boarding ladder to the supporting structure at the top surface, particularly in the case of a boat deck, yet provide for the ladder to swing downward into the water or alongside the boat or the dock for use.

DESCRIPTION OF THE PREFERRED EMBODIMENTTS

Figure 1:
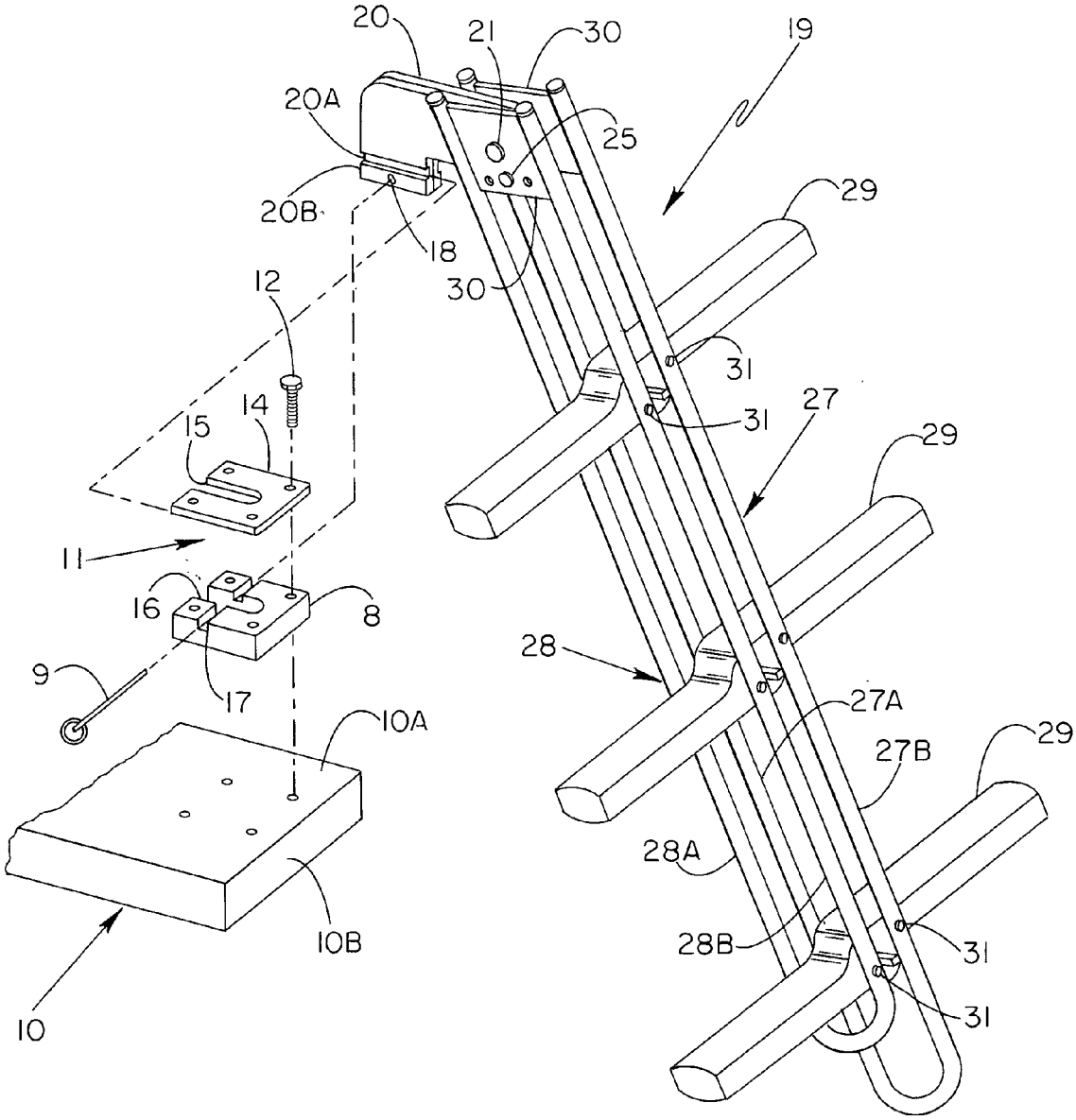
FIG. 1 is a perspective partly blown-apart view of a preferred embodiment of the invention with a boarding ladder attached.

Attached to the top surface 10A of a rigid support platform 10 which may be a boat deck or a dock is a mounting bracket identified by reference numeral 11. Bracket 11 may be secured to the top of the support platform 10 in some conventional fashion such as by bolts 12 with its back side resting parallel to and flat against the horizontal surface 10A. In the illustrated preferred embodiment bracket 11 has a back section 8 which has an open end elongated recess or slot 16 and a front plate 14 which has a corresponding generally centrally located elongated slot 15. A latch member 20 has grooves 20A located near one end for slidably engaging slot 15 in bracket 11 with the end portion of the latch member at 20B resting in slot 16. With the latch member slots 20A and end portion 20B engaged with the respectively corresponding slots in the bracket 11, a locking pin 9 may be inserted through a suitable cross-slot 17 in bracket 11 to engage a corresponding opening 18 in latch member 20 to releasably lock the latch member 20 in place onto bracket 11. Preferably the height of bracket 11, i.e., the degree that it rises above the top surface 10A of platform 10, is kept as short as possible to present a low profile for aesthetic purposes and also to minimize any danger to anyone on the boat deck or dock from tripping or otherwise harmfully stepping on the bracket when the bracket is not being used.

In the illustrated preferred embodiment latch 20 is L-shaped or at a right angle. When latch member 20 is engaged at about its one end with the bracket 11 as described hereinabove and as illustrated it extends upward from bracket 11 and is angled at about ninety degrees outward so that its other end extends out beyond the side edge 10B of the boat deck or dock. At about its outer end which extends out over the edge of the supporting platform, latch member 20 has a pivot pin 21 for pivotally engaging a boarding ladder such as illustrated in FIG. 1 and identified by reference numeral 19. In this fashion then the boarding ladder 19 can be releasably coupled to the mounting bracket 11 by latch member 20 and is free to swing downward beyond the edge of the boat deck or dock toward and into the water for use.

Preferably the docking ladder has a series of holes 26 for receiving a threaded stop member 25 for engaging a cutout 24 at the arcuate end 23 of latch member 20 so that the ladder can be adjusted to rest at various angles as desired by the user.

Figure 2:
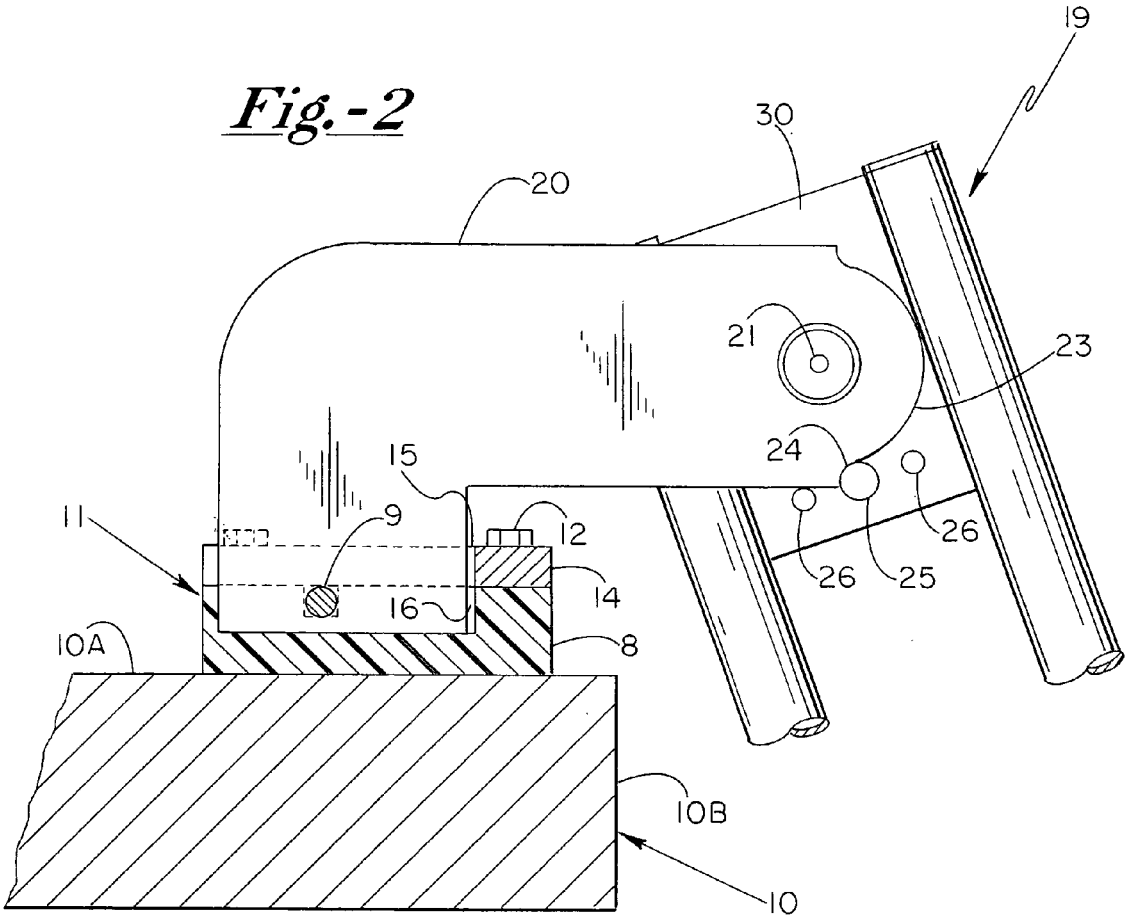
FIG. 2 is an enlarged sectioned side view showing in greater detail the manner in which a boarding ladder is engaged with a preferred embodiment of the invention.
Figure 3:
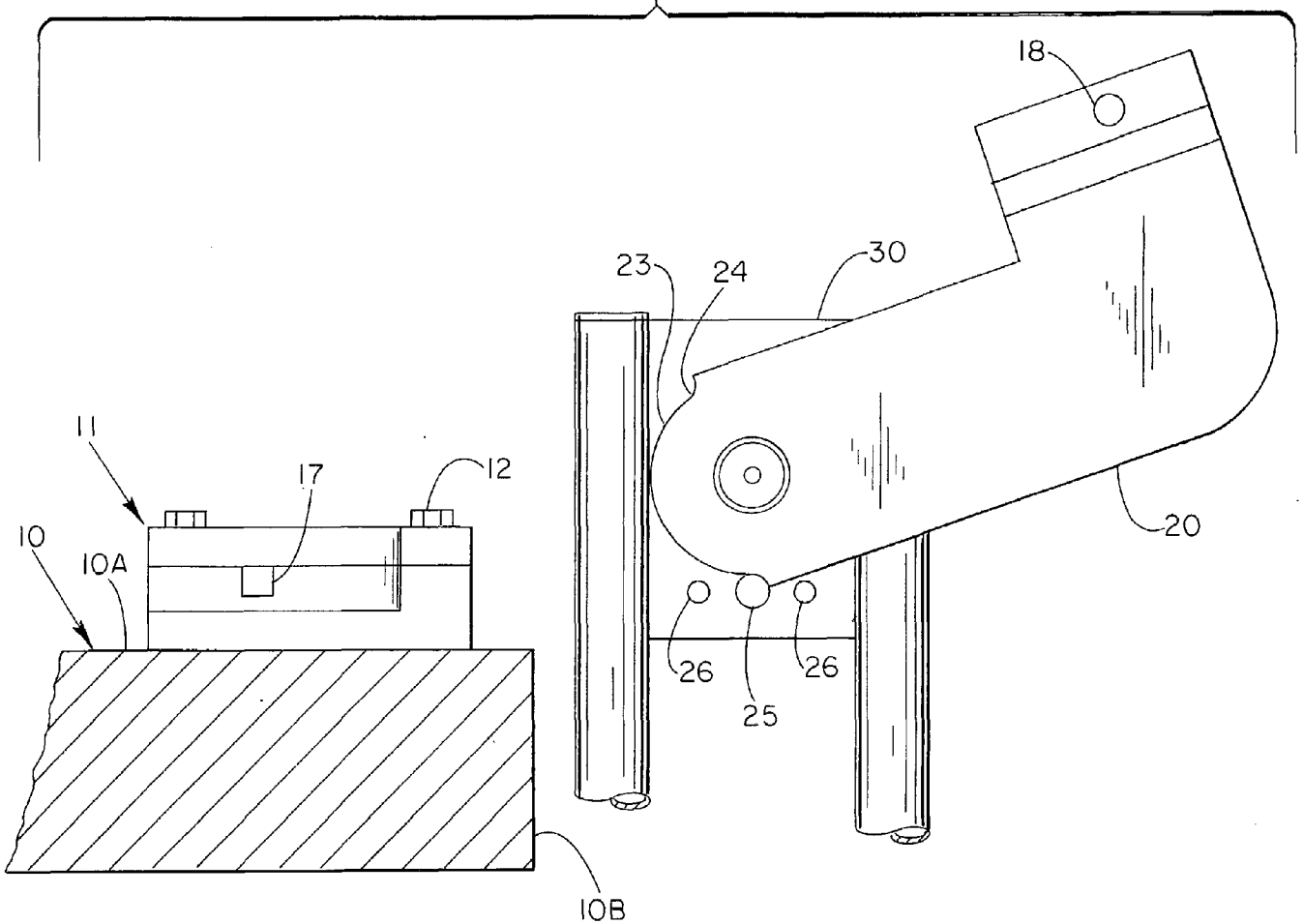
FIG. 3 is a view similar to FIG. 2 but showing the boarding ladder disengaged.
Figure 4:
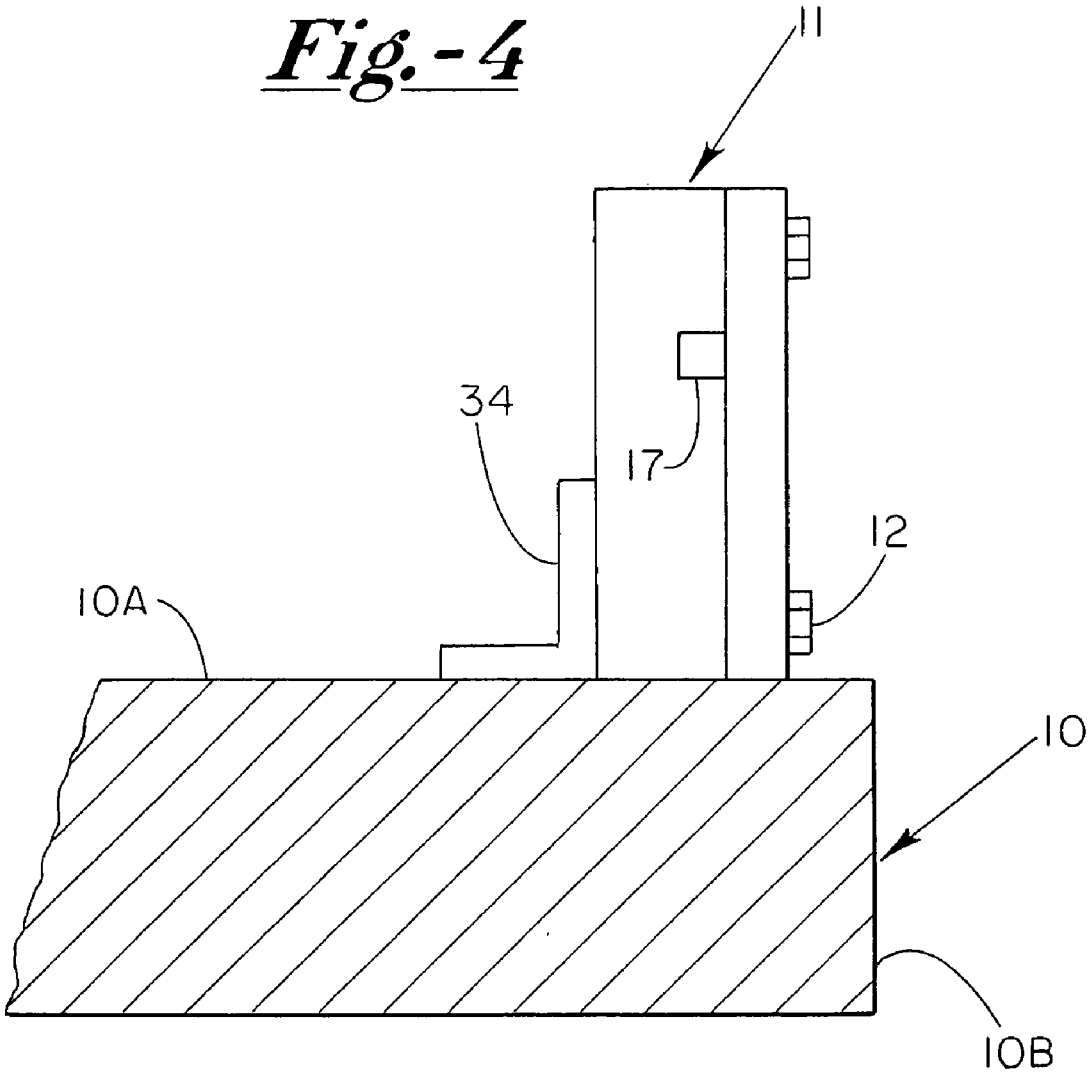
FIG. 4 illustrates a variation of an embodiment of the invention.

As mentioned earlier, it is oftentimes convenient to releasably attach the boarding ladder to the top surface of the supporting platform such as the boat deck or dock and yet allow the ladder to swing down toward and into the water. Although preferably, as mentioned hereinabove, the bracket should have a low profile by being parallel to the top surface of the supporting platform and be of minimal height, variations may have the bracket raised at different angles upward from the surface of the supporting platform. In those cases the latch member would be angled at other than ninety degrees to extend out over the edge of the supporting platform. In an extreme case, as illustrated in FIG. 4, the bracket can be mounted on the top surface 10A of the supporting platform vertically or at ninety degrees by a right angle support 34. In that case, the latch member 20 would be at zero degree angle and would merely extend straight out over the edge of the supporting platform from its attachment to the bracket. Other embodiments may have the bracket at other angles between zero (FIGS. 1–3) and ninety degrees (FIG. 4).

The drawings illustrate the mounting apparatus used in conjunction with a foldable or compactable boat or dock loading ladder 19. This type of ladder is more clearly described in co-pending application Ser. No. 10/438,394 titled "COMPACTABLE BOAT LADDER" filed May 16, 2003. The ladder center support comprises a pair of centrally located elongated rigid tubular members 27 and 28. Preferably each of the ladder support members 27 and 28 comprises a pair of rigid tubes including a back member 27A and 28A and front member 27B and 28B, respectively. Ladder rungs or steps 29 are longitudinally spaced along the support members 27 and 28 and are pivotably attached to both the front and back members 27A and 27B and 28A and 28B at 31. The arrangement is such that when one of the support members is moved lengthwise with respect to the other support member the rungs or steps 29 are swung about their respective pivot points 31 to extend outward sideways from the support members 27 and 28 for use and when the support member is moved longitudinally in the opposite direction the steps swing inward to rest in the areas between the front and back members 27A and 27B and 28A and 28B so that the ladder is folded or compacted for storage. To use the mounting apparatus described hereinabove with a foldable or compactable ladder, a plate 30 is fixedly attached between the front and back members 27A and 27B and 28A and 28B of support members 27 and 28. Each plate 30 is pivotally attached at 21 to latch member 20 so that when the ladder is in the use position and latch member 20 coupled to bracket 11, the ladder 19 is pivotally attached to bracket 11 and to the boat or dock 10.

I claim:

1. Apparatus for releasably attaching a boarding ladder to a platform such as a boat deck or dock, comprising the combination of:

a) a generally planar mounting bracket fixedly attached to the substantially horizontal top surface of a rigid supporting platform;

b) said bracket having a back resting against said surface and a front plate member, said plate member having side edges and a slot located between said side edges;

c) a latch member slidably engaging said slot at about one end of said latch member;

d) said latch member angled with respect to said bracket to extend beyond an outer edge of the supporting platform when engaged with said bracket and having a pivot pin at about its outer end said pivot pin pivotally engaging a boarding ladder.

2. Apparatus for releasably attaching a boarding ladder to a supporting platform as described in claim 1 further including:

a) an arcuate cutout at about the outer end of said latch member for engaging a stop on an engaged ladder for holding the ladder at an angle with respect to said supporting platform.

3. Apparatus for releasably attaching a boarding ladder to a platform such as a boat deck or dock, comprising the combination of:

a) a generally planar mounting bracket fixedly attached to the substantially horizontal top surface of a rigid supporting platform;

b) said bracket having a back resting against said surface and a front plate member, said plate member having side edges and a slot located between said side edges;

c) a latch member having means at about one end for slidably engaging said slot;

d) said latch member angled away from said bracket to extend beyond an outer edge of the supporting platform when engaged with said bracket and having means at about its outer end for pivotally engaging a boarding ladder.

* * * * *